US009850605B2

(12) United States Patent
Yun et al.

(10) Patent No.: US 9,850,605 B2
(45) Date of Patent: Dec. 26, 2017

(54) MULTIPURPOSE FUNCTIONAL NONWOVEN FIBER, AND METHOD FOR MANUFACTURING SAME

(75) Inventors: Gapho Yun, Busan (KR); Giho Yun, Busan (KR); Hakbum Kim, Gyeongju-si (KR); Kwang Hui So, Daegu (KR); Eunhak Song, Daegu (KR)

(73) Assignee: KOREA COTTON CO., LTD., Seoul (KR)

( * ) Notice: Subject to any disclaimer, the term of this patent is extended or adjusted under 35 U.S.C. 154(b) by 867 days.

(21) Appl. No.: 14/348,548

(22) PCT Filed: Oct. 25, 2011

(86) PCT No.: PCT/KR2011/007959

§ 371 (c)(1),
(2), (4) Date: Mar. 28, 2014

(87) PCT Pub. No.: WO2013/047943

PCT Pub. Date: Apr. 4, 2013

(65) Prior Publication Data

US 2014/0235131 A1 Aug. 21, 2014

(30) Foreign Application Priority Data

Sep. 28, 2011 (KR) ..... 10-2011-0098626

(51) Int. Cl.
*D04H 1/498* (2012.01)
*D04H 1/4374* (2012.01)
(Continued)

(52) U.S. Cl.
CPC ..... *D04H 1/498* (2013.01); *D04H 1/425* (2013.01); *D04H 1/4242* (2013.01);
(Continued)

(58) Field of Classification Search
CPC ..... D04H 1/46; D04H 1/4242; D04H 1/4209; D04H 1/425; D04H 1/4266; D04H 1/4374;
(Continued)

(56) References Cited

U.S. PATENT DOCUMENTS 3,752,721 A * 8/1973 Clark et al. ..... B29C 70/08 156/148
4,251,589 A * 2/1981 Romaniec ..... D01F 9/16 423/447.1
(Continued)

FOREIGN PATENT DOCUMENTS

EP 1416079 A1 5/2004
JP 08-500065 A 1/1996
(Continued)

OTHER PUBLICATIONS

Japanese Office Action dated Mar. 27, 2015 of corresponding Patent Application No. 2014-533174 (no English translation).
(Continued)

*Primary Examiner* — Amy Vanatta
(74) *Attorney, Agent, or Firm* — Lucas & Mercanti, LLP

(57) ABSTRACT

The present invention relates to a multipurpose functional nonwoven fabric, and more particularly, to a multipurpose functional nonwoven fabric which is manufactured by performing a pretreatment process on carbonized fiber cotton, and stacking the pretreated carbonized fiber on natural cotton, mixing the pretreated carbonized fiber cotton with the natural cotton and scutching the mixed cotton, or introducing the natural cotton and stacking the natural cotton on an intermediate layer of the pretreated carbonized fiber, and a method for manufacturing same. Web formation and stacking at a cutting machine can be easily performed by performing the pretreatment process on the carbonized fiber. Also, excellent heat resistance and conductivity can be
(Continued)

obtained by stacking the carbonized fiber cotton on natural cotton, mixing the carbonized fiber cotton with the natural cotton, scutching the mixed carbonized fiber cotton and the natural cotton and stacking the scutched cotton, or introducing natural cotton into an intermediate layer of the carbonized fiber cotton, stacking the natural cotton on the intermediate layer of the carbonized fiber cotton, and subjecting the stacked cotton to needle punching. Since a surface temperature of the nonwoven fabric can be lowered and the loss of heat can be reduced through dissipation and dispersion of heat, thermal retention and insulation properties of the entangled natural cotton can be enhanced, and carbonization prevention and incombustiblization of the natural cotton can be achieved. Also, the multipurpose functional nonwoven fabric can be manufactured at a low production cost and exhibit environmentally friendly characteristics, and a waste material can be recycled.

9 Claims, 10 Drawing Sheets

(51) Int. Cl.

| | |
|---|---|
| ***D04H 1/425*** | (2012.01) |
| ***D04H 1/4242*** | (2012.01) |
| ***D04H 1/46*** | (2012.01) |
| ***D04H 1/70*** | (2012.01) |
| ***D04H 3/00*** | (2012.01) |
| ***D04H 1/74*** | (2006.01) |

(52) U.S. Cl.
CPC ..... *D04H 1/4374* (2013.01); *D04H 1/46* (2013.01); *D04H 1/70* (2013.01); *D04H 1/74* (2013.01); *D04H 3/00* (2013.01); *Y10T 442/687* (2015.04)

(58) Field of Classification Search
CPC D04H 1/70; D04H 1/498; D04H 1/74; D04H 3/00; D04H 3/02; D04H 3/102; D04H 3/105; D04H 5/02; D04H 18/02
USPC ..... 28/107, 112, 167
See application file for complete search history.

(56) References Cited

U.S. PATENT DOCUMENTS

| | | | | |
|---|---|---|---|---|
| 4,714,649 | A * | 12/1987 | Edwards | D01F 9/145 428/408 |
| 5,645,926 | A * | 7/1997 | Horrocks | A41D 31/0022 428/920 |
| 5,766,745 | A * | 6/1998 | Smith | B32B 5/26 428/218 |
| 6,156,681 | A * | 12/2000 | Tamaru | B01D 39/083 156/148 |
| 2003/0171055 | A1* | 9/2003 | Endo | D04H 1/45 442/403 |
| 2004/0242107 | A1* | 12/2004 | Collins | A47C 31/001 442/403 |
| 2005/0020164 | A1* | 1/2005 | Nakamura | D04H 1/4374 442/181 |
| 2005/0118919 | A1 | 6/2005 | Link et al. | |
| 2006/0040580 | A1* | 2/2006 | Ogle | B32B 5/022 442/389 |
| 2006/0083911 | A1* | 4/2006 | Ogle | B29C 70/50 428/297.4 |
| 2006/0228968 | A1 | 10/2006 | Ogle | |
| 2007/0066175 | A1* | 3/2007 | Wolf | A47C 31/001 442/415 |
| 2007/0293114 | A1 | 12/2007 | Ogle | |
| 2010/0261397 | A1 | 10/2010 | Sabourin et al. | |
| 2011/0165397 | A1* | 7/2011 | Roe | D04H 1/435 428/219 |

FOREIGN PATENT DOCUMENTS

| | | | |
|---|---|---|---|
| JP | 09-217256 | A | 8/1997 |
| JP | 09-511802 | A | 11/1997 |
| JP | 2000008260 | A | 1/2000 |
| JP | 2000347670 | A | 12/2000 |
| JP | 2005334425 | A | 12/2005 |
| JP | 2009179895 | A | 8/2009 |
| JP | 2009249780 | A | 10/2009 |
| JP | 2010-095815 | A | 4/2010 |
| KR | 10-0139559 | | 4/1998 |
| KR | 20-0179333 | | 2/2000 |
| KR | 10 2001 0109590 | A | 12/2001 |
| KR | 10 0337537 | B1 | 5/2002 |
| KR | 20 0321867 | | 7/2003 |
| KR | 10 0485138 | | 5/2005 |
| KR | 20 0432661 | | 11/2006 |
| KR | 10 0745170 | B1 | 8/2007 |
| WO | 2010107022 | A1 | 9/2010 |

OTHER PUBLICATIONS

International Search Report dated Oct. 29, 2012.
Extended European Search Report dated Oct. 16, 2015 of corresponding Patent Application No. 11873025.8-1308.

* cited by examiner

Multipurpose functional advanced nonwoven fabric obtained by mixing natural cotton with carbonized fiber cotton, scutching the resulting mixed cotton and entangling the mixed cotton through needle punching

FIG. 10

TEST REPORT

Client: ENERSYS CO., LTD
Address: 724 Wiyang-ri, Seosaeng-myeon, Ulju-gun, Ulsan, Korea
Name: Nonwoven Fabric
Samples Provided by the Client: Multipurpose Functional Nonwoven Fabric Report No.: T216-11-00921
Report Issue Date: June 19, 2011
Use: Quality Control
Page: 1/2

As requested on June 18, 2011, the test results on the samples are as described below.

| Test items | Test results |
|---|---|
| (01) Tensile Strength (KS K 0521:2006, C.R.E. Strip Method): N/5 cm (kgf/5 cm) | |
| | #3 |
| Length | 406 (41) |
| Width | 2231 (227) |

Note) As requested by the client, the unit "kgf/5 cm" was written together with the measured values. The coefficient used to convert kgf/5 cm into N (Newton)/5 cm was 9.80665.

| (02) Bursting Strength (KS K 0351:2006, Hydraulic Method): KPa (kgf/5 cm) | |
|---|---|
| | #3 |
| | 4903 or more (50 or more) |

Note) As requested by the client, the unit "kgf/5 cm" was written together with the measured values.
The coefficient used to convert kgf/5 cm into N (Newton)/5 cm was 98.0665.

<Continued>

This test report as a result of testing provided samples does not guarantee the quality of whole products, and the name of samples is provided by the client.
This test report cannot be used for public relations, propagation, advertisement and litigation without prior written consent of the FITI, and use of this test report for other purposes is prohibited.

Executive Director of
FITI Testing &
Research Institute

| (03) Cold resistance (Test Provided by the Client): Appearance Evaluation | |
|---|---|
| | #1 |
| | None |

Note) Test Conditions: –40 °C, 6 Hours

(04) Flame retardancy (Law Enforcement Ordinance of Maintenance and Safety Control of Fire-Fighting Systems, Meker Burner Method)

| | #2 |
|---|---|
| After-flame time (S) | 0 |
| After-glow time (S) | 0 |
| Carbonization area (cm2) | 26.2 |
| Carbonization length (cm) | 6.9 |
| Acceptance | Pass |

Note) Test Criteria: Law Enforcement Ordinance of Maintenance and Safety Control of Fire-Fighting Systems (Veneer Board, Fiber Board)

After-flame time (S) : Within 10
After-glow time (S) : Within 30
Carbonization area (cm2) : Within 50
Carbonization length (cm) : Within 20

MULTIPURPOSE FUNCTIONAL NONWOVEN FIBER, AND METHOD FOR MANUFACTURING SAME

CROSS-REFERENCE TO RELATED APPLICATIONS

This application is a 371 of PCT/KR2011/007959, filed Oct. 25, 2011, which claims the benefit of Korean Patent Application No. 10-2011-0098626, filed Sep. 28, 2011.

TECHNICAL FIELD

The present invention relates to a multipurpose functional nonwoven fabric, and more particularly, to a multipurpose functional nonwoven fabric which is prepared by performing a pretreatment process on carbonized fiber cotton, and stacking the pretreated carbonized fiber cotton on natural cotton, mixing natural cotton with the pretreated carbonized fiber cotton and scutching the mixed cotton, or introducing natural cotton into an intermediate layer of the pretreated carbonized fiber cotton and stacking the pretreated carbonized fiber cotton on the natural cotton, and a method for manufacturing the same.

BACKGROUND ART

In recent years, nonwoven fabrics have been widely used for clothing, materials for industry, engineering construction, agriculture, and various filters in surroundings of human life and various industrial fields. The kinds of nonwoven fabrics are divided into staple nonwoven fabrics manufactured by carding a staple and subjecting the carded staple to a needle punching process, and filament nonwoven fabrics manufactured using a spunbond or spunlace process. Conventional nonwoven fabrics were manufactured using a method of manufacturing a nonwoven fabric using a glass fiber or a carbon fiber so as to achieve flame retardancy (fire retardancy). Korean Published Patent No. 2001-79333 (Nov. 17, 1999) discloses a fire-fighting sheet manufactured by inserting a glass fiber mesh between a pair of carbon fiber nonwoven fabrics, allowing a sewing machine needle to stitch up and down each mesh hole, and entangling an upper carbon fiber nonwoven fabric with a lower glass fiber.

The carbon fiber nonwoven fabric manufactured by such a method has an advantage in that a carbon fiber and a glass fiber has excellent heat-retardant and flame-retardant performance, but has problems in that it is difficult to perform a needle punching process through mesh holes of the glass fiber, the glass fiber is scattered in the form of fine dusts during a needle punching process, and thus is harmful to the human body, skin, and eyes of workers, needles are severely damaged due to a compressive force of a needle plate, and the needle-punched nonwoven fabric is damaged. Also, the carbon fiber or glass fiber has problems in that it has a poor thermal insulation property and economic feasibility, and excessive workability is required due to its heavy weight, which leads to a reduction in work efficiency. Also, the carbon fiber or glass fiber has problems in that it is vulnerable to fire since it has no flame-retardancy, and has poor bursting strength and tensile strength.

Therefore, the present inventors have endeavored to develop a multipurpose functional nonwoven fabric and a method for manufacturing the same in order to solve the problems of the prior art.

DISCLOSURE

Technical Problem

Therefore, the present invention is directed to a multipurpose functional nonwoven fabric capable of realizing web formation and stacking by subjecting a carbonized fiber to a pretreatment process, and a method for manufacturing the same. Also, the present invention is directed to a multipurpose functional nonwoven fabric having excellent heat resistance and conductivity, which is manufactured by stacking carbonized fiber cotton on natural cotton, mixing natural cotton with carbonized fiber cotton and scutching and stacking the mixed cotton, or introducing natural cotton into an intermediate layer of carbonized fiber cotton and stacking the natural cotton on the intermediate layer of the carbonized fiber cotton and subjecting the stacked cotton to needle punching, and a method for manufacturing the same.

However, the objects of the present invention are not limited thereto, and other objects of the present invention which are not disclosed herein will become more apparent to those of ordinary skill in the art by describing in detail exemplary embodiments thereof.

Technical Solution

According to an aspect of the present invention, there is provided a method for manufacturing a multipurpose functional nonwoven fabric. Here, the method includes (1) preparing carbonized fiber cotton by unraveling a carbonized fiber and mixing the carbonized fiber and raw cotton at a mixing ratio of 6:4 to 8:2, (2) injecting the carbonized fiber cotton into a cutting machine to form a web, (3) stacking the web-formed carbonized fiber cotton and the natural cotton so that the web-formed carbonized fiber cotton is positioned on the natural cotton and needle-punching the stacked cotton, and (4) subjecting the needle-punched cotton to flame-retardant and fire-retardant treatment, dehydration, and drying.

According to another aspect of the present invention, there is provided a method for manufacturing a multipurpose functional nonwoven fabric. Here, the method includes (1) preparing carbonized fiber cotton by unraveling a carbonized fiber and mixing the carbonized fiber and raw cotton at a mixing ratio of 6:4 to 8:2, (2) injecting the carbonized fiber cotton into a cutting machine to form a web, (3) introducing natural cotton into an intermediate layer of the web-formed carbonized fiber cotton, stacking the natural cotton on the intermediate layer of the web-formed carbonized fiber cotton, and needle-punching the stacked cotton, and (4) subjecting the needle-punched cotton to flame-retardant and fire-retardant treatment, dehydration, and drying.

According to still another aspect of the present invention, there is provided a method for manufacturing a multipurpose functional nonwoven fabric. Here, the method includes (1) preparing carbonized fiber cotton by unraveling a carbonized fiber and mixing the carbonized fiber and raw cotton at a mixing ratio of 6:4 to 8:2, (2) mixing natural cotton with the carbonized fiber cotton and scutching the resulting mixed cotton, (3) injecting the mixed/scutched cotton into a cutting machine to form a web, stacking the web-formed cotton, and needle-punching the stacked cotton, and (4) subjecting the needle-punched cotton to flame-retardant and fire-retardant treatment, dehydration, and drying.

According to one exemplary embodiment of the present invention, the needle punching conditions may include revolutions per minute (rpm) of 200 to 800 rpm, a speed of 2.0 to 5.0 m/min, No. of needles of 4,000 to 4,500 EA/m, and a beat density of 40 to 72 counts/$cm^2$. Also, the needle punching may be reciprocatively performed once from top to bottom and once from bottom to top.

According to yet another aspect of the present invention, there is provided a multipurpose functional nonwoven fabric manufactured using the above-described method. Here, the multipurpose functional nonwoven fabric may be used for at least one selected from the group consisting of a thermal retention material, a flame-retardant material, a thermal insulation material, a heating material, a sound-proof material, an intermediate material for absorption of impact, a buffering material, a bullet-proof material, a knife-proof material, and a fire-fighting material.

According to one exemplary embodiment of the present invention, the multipurpose functional nonwoven fabric may be used for at least one selected from the group consisting of a pipe, a valve, an elbow, a turbine, a rotational machine, a waste gas valve, a wall of a boiler, and a large engine. Also, the multipurpose functional nonwoven fabric may be used as a cryogenic thermal retention/insulation material in at least one selected from the group consisting of a transportation/storage system for LNG and LPG gases transported and stored in a liquefied state, a vessel, a vehicle, a storage tank, a pipe, a valve, a refrigeration warehouse, and a refrigerator. Further, the multipurpose functional nonwoven fabric may be used as a flame-retardant material or a thermal insulation material in at least one selected from the group consisting of a flame-resistant curtain, a screen roll, a flame/fire prevention blanket, a fire-fighting blanket, and fire protection facilities. Also, the multipurpose functional nonwoven fabric may be used as a bullet-proof material, a knife-proof material, or a fire-fighting material in at least one selected from the group consisting of a police uniform, a military uniform, a bulletproof jacket, a fire-fighting garment, fire-fighting gloves, fire-fighting boots, special working clothes, and industrial steel-capped boots used in a high temperature. In addition, the multipurpose functional nonwoven fabric may be used as an intermediate material for absorption of impact or a buffering material in at least one selected from the group consisting of a bumper for automobiles, human body guards, a safety helmet, and a helmet. Furthermore, the multipurpose functional nonwoven fabric may be used as an intermediate material or a core material selected from the group consisting of a sandwich panel, a metal panel, an aluminum composite panel, and a refrigeration panel.

Advantageous Effects

According to the present invention, web formation and stacking in a cutting machine can be easily realized by subjecting a carbonized fiber to a pretreatment process.

Also, excellent heat resistance and conductivity can be obtained by stacking carbonized fiber cotton on natural cotton, mixing natural cotton with carbonized fiber cotton, scutching and stacking the mixed cotton, or introducing natural cotton into an intermediate layer of the carbonized fiber cotton, stacking the natural cotton on the intermediate layer of the carbonized fiber cotton, and subjecting the stacked cotton to needle punching. When heat is applied to a nonwoven fabric, the heat is rapidly dissipated and dispersed in a surface area of the nonwoven fabric, and a surface temperature of the nonwoven fabric can be lowered and the loss of heat can be reduced. As a result, thermal retention and insulation properties of the entangled natural cotton can be enhanced, and carbonization prevention and incombustiblization of the natural cotton can be achieved.

In addition, the multipurpose functional nonwoven fabric can be manufactured at a low production cost and exhibit environmentally friendly characteristics, and a waste material can be recycled after use in the near future.

Therefore, the multipurpose functional nonwoven fabric according to the present invention can be used for materials for fire protection in electric power conduits such as a flame-retardant thermal retention/insulation material, a flame-retardant/cold-resistant material, a flame-retardant sound-absorbing material, a cryogenic thermal retention/insulation material for flame-retardant LNG and LPG gases, a thermal retention/insulation material used for flame retardancy at a high temperature, a flame-retardant high-temperature filtering material, a flame-retardant interior material, a flame-retardant filament, a processed woven fabric, a mat, a board, a sandwich panel, and a metal panel, and interior materials such as a flame prevention blanket upon welding and a wallpaper, and can be used in various industrial fields such as a flame-resistant curtain, a fire-fighting garment, an assault jacket, and the like.

DESCRIPTION OF DRAWINGS

FIG. 10 is a diagram showing a test report on the multipurpose functional nonwoven fabric according to the present invention.

BEST MODE

Figure 1:
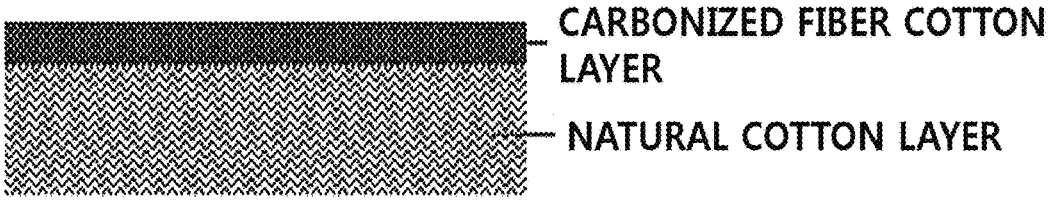
FIG. 1 is a diagram showing a multipurpose functional nonwoven fabric manufactured by stacking carbonized fiber cotton on natural cotton.

When a nonwoven fabric is punched by repeatedly performing an up-and-down motion on the front or rear surface of a stacked fiber layer using a needle, a fiber layer having a uniform thickness and fiber density is formed.

The present invention is directed to a multipurpose functional nonwoven fabric. A carbonized fiber and a natural fiber are used as source materials. Here, the carbonized fiber is subjected to a pretreatment process, and the natural fiber is positioned under or in the carbonized fiber, or the carbonized fiber is mixed with the natural fiber, and the mixed fiber is scutched, followed by subjecting the scutched fiber to a needle punching process. Thereafter, the needle-punched fiber is subjected to flame-retardant and fire-retardant treatment, dehydration, drying, and restoration process, thereby manufacturing a multipurpose functional nonwoven fabric. The multipurpose functional nonwoven fabric manufactured according to the manufacturing method proposed in the present invention is useful in facilitating web formation and stacking in a cutting machine, shows excellent heat resistance and conductivity, and has improved thermal retention and insulation properties. Hereinafter, respective operations of the method according to the present invention will be described in further detail.

The present invention is directed to a method of manufacturing a multipurpose functional nonwoven fabric. Here, the method includes (1) preparing carbonized fiber cotton by unraveling a carbonized fiber and mixing the carbonized fiber and raw cotton at a mixing ratio of 6:4 to 8:2, (2) injecting the carbonized fiber cotton into a cutting machine to form a web, (3) stacking the web-formed carbonized fiber cotton and the natural cotton so that the web-formed carbonized fiber cotton is positioned on the natural cotton and needle-punching the stacked cotton, and (4) subjecting the needle-punched cotton to flame-retardant and fire-retardant treatment, dehydration, and drying.

Also, the present invention is directed to a method of manufacturing a multipurpose functional nonwoven fabric. Here, the method includes (1) preparing carbonized fiber cotton by unraveling a carbonized fiber and mixing the carbonized fiber and raw cotton at a mixing ratio of 6:4 to 8:2, (2) injecting the carbonized fiber cotton into a cutting machine to form a web, (3) introducing natural cotton into an intermediate layer of the web-formed carbonized fiber cotton, stacking the natural cotton on the intermediate layer of the web-formed carbonized fiber cotton, and needle-punching the stacked cotton, and (4) subjecting the needle-punched cotton to flame-retardant and fire-retardant treatment, dehydration, and drying.

Further, the present invention is directed to a method of manufacturing a multipurpose functional nonwoven fabric. Here, the method includes (1) preparing carbonized fiber cotton by unraveling a carbonized fiber and mixing the carbonized fiber and raw cotton at a mixing ratio of 6:4 to 8:2, (2) mixing natural cotton with the carbonized fiber cotton and scutching the resulting mixed cotton, (3) injecting the mixed/scutched cotton into a cutting machine to form a web, stacking the web-formed cotton, and needle-punching the stacked cotton, and (4) subjecting the needle-punched cotton to flame-retardant and fire-retardant treatment, dehydration, and drying.

In the manufacturing method according to the present invention, operation (1) is an operation of pretreating a carbonized fiber before formation of a web using the carbonized fiber. More particularly, since the carbonized fiber has a specific gravity of 1.47 and a smooth texture, when the carbonized fiber is fed into a cutting machine to form fine cotton (a web), the web is not easily formed, the carbonized fiber is rolled down to the bottom of the cutting machine, and a web of carbonized fiber cotton is not rolled up by a stacking roller, which makes impossible to stack the carbonized fiber. To solve the above problems in the present invention, first, a carbonized fiber (1,000 g) and 5 to 30% (50 to 300 g) of raw cotton are mixed in an opener device. In this case, the carbonized fiber in the form of a stable fiber (i.e., a wool-like curled shape or a corrugated paper-like shape) is unraveled, and then mixed with raw cotton. The mixture prepared using such a method is easily stacked since a web is easily formed when the mixture is injected to a cutting machine. Also, cotton of the carbonized fiber is first unraveled as described above, and is fed into a cutting machine to process a web of carbonized fiber, thereby forming a fiber web having a thickness of 30 to 100 mm.

After the manufacture of the carbonized fiber cotton, a web of carbonized fiber cotton and natural cotton is formed, and the carbonized fiber cotton is stacked on the natural cotton. Then, the stacked cotton is subjected to needle punching (Operations ((2) and (3)).

According to one exemplary embodiment of the present invention, the carbonized fiber cotton undergoing the pretreatment process is injected into a cutting machine to form a web, and stacked on the natural cotton. Thereafter, the carbonized fiber cotton (a thickness of 30 to 100 mm) and the natural cotton (a thickness of 60 to 240 mm) are stacked such that the carbonized fiber cotton is positioned on (outside) the natural cotton. At the same time, the stacked cotton is fed into a feeding roller, and reciprocatively needle-punched twice, that is, once from top to bottom and once from bottom to top. The needle punching conditions may include revolutions per minute (rpm) of 200 to 800 rpm, a speed of 2.0 to 5.0 m/min, No. of needles of 4,000 to 4,500 EA/m, and a beat density of 40 to 72 counts/cm$^2$. After the needle punching process, the thickness of the carbonized fiber entangled on the natural cotton decreases from approximately 30 mm to approximately 2 mm, and the thickness of the needle-punched nonwoven fabric of lower natural cotton decreases from approximately 60 mm to approximately 10 mm (see FIG. 1).

According to another exemplary embodiment of the present invention, the pretreated carbonized fiber cotton is mixed with natural cotton, and the mixed cotton is scutched. Thereafter, the scutched cotton is introduced into a cutting machine to form a web, and stacked to have a thickness of 60 mm. Subsequently, the stacked mixed cotton is subjected to needle punching (rpm: 200 to 800 rpm, speed: 2.0 to 5.0 m/min, No. of needles: 4,000 to 4,500 EA/m, and beat density: 40 to 72 counts/cm$^2$) (see FIG. 2).

Figure 3:
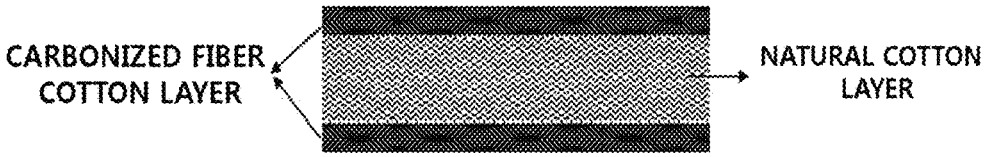
FIG. 3 is a diagram showing a multipurpose functional nonwoven fabric manufactured by introducing natural cotton into an intermediate layer of carbonized fiber cotton and stacking the natural cotton on the intermediate layer of the web-formed carbonized fiber cotton.

According to still another exemplary embodiment of the present invention, the natural cotton is introduced into an intermediate layer of the pretreated carbonized fiber cotton so that the natural cotton is stacked on the intermediate layer of the pretreated carbonized fiber cotton, and the carbonized fiber cotton and the natural cotton are subjected to needle punching (rpm: 200 to 800 rpm, speed: 2.0 to 5.0 m/min, No. of needles: 4,000 to 4,500 EA/m, and beat density: 40 to 72 counts/cm$^2$) so that the carbonized fiber cotton and natural cotton are entangled with each other (see FIG. 3).

Figure 4:
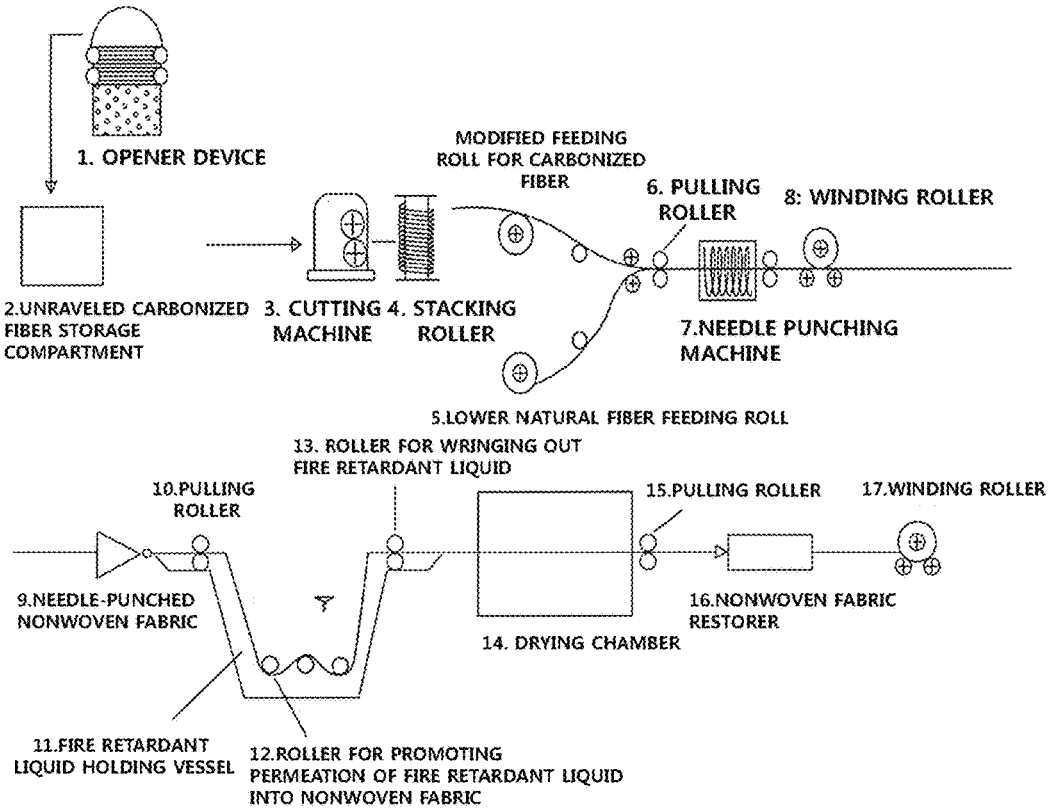
FIG. 4 is a diagram showing a method of manufacturing a multipurpose functional nonwoven fabric according to the present invention.

The needle-punched cotton obtained according to the above method is subjected to flame-retardant (fire-retardant) treatment, and dehydration, drying, and restoration processes to manufacture a nonwoven fabric (see FIG. 4). According to this exemplary embodiment, the flame-retardant (fire-retardant) treatment may be performed by immersing the needle-punched cotton in a composition including an aqueous ammonium solution, monobasic ammonium phosphate, boron, an anionic surfactant, a fluorinated water-repellent, and an acrylic phosphate-based coupling agent. Also, the needle-punched cotton may be dehydrated using a mangle dehydrator, and dried using a dielectric-heat dryer or a hot air dryer.

As shown in FIG. 4, the method of manufacturing a nonwoven fabric according to the present invention includes unraveling a carbonized fiber that is a stable fiber (having a wool-like curled shape or a corrugated paper-like shape) by mixing raw cotton with a carbonized fiber in an opener device in order to form a web with the carbonized fiber, injecting the carbonized fiber into a cutting machine to form a web, stacking the carbonized fiber at a stacking roller, feeding the stacked carbonized fiber upward through a feeding roll and simultaneously feeding and stacking a natural fiber at a lower feeding roll, and reciprocatively needle-punching the stacked fibers at a needle punching machine in a vertical direction. Also, the needle-punched nonwoven fabric is wound around a "roll" by means of a winding roller, and the nonwoven fabric is put into a flame-retardant (fire-retardant) liquid holding vessel so that a flame-retardant (fire-retardant) liquid is easily immersed into the nonwoven fabric. Then, the nonwoven fabric is subjected to a dehydration process in a mangle compressive dehydrator, and dried in a dielectric-heat dryer or a hot air dryer. A slightly stiffened edge of the multipurpose functional nonwoven fabric is restored to an original state in a restorer, and produced by a winding roller.

The multipurpose functional nonwoven fabric manufactured by the method provided in the present invention may be used in various industrial fields including a flame-retardant thermal retention/insulation material, a flame-retardant/cold-resistant material, a flame-retardant sound-absorbing material, a cryogenic thermal retention/insulation material for flame-retardant LNG and LPG gases, a thermal retention/insulation material used for flame retardancy at a high temperature, a flame-retardant high-temperature filtering material, and a flame-retardant interior material.

As described above, according to a method of stacking the natural cotton and the carbonized fiber cotton performed before a needle punching process provided in the present invention, thermal retention and insulation properties may be further improved, carbonization on a surface of natural cotton may be prevented, and incombustiblization of the natural cotton may be achieved. Therefore, according to the present invention, the nonwoven fabric capable of being used for multiple purposes due to significantly improved qualities and functions of products may be provided.

More particularly, when a layer of carbonized fiber cotton is entangled with the top layer (outer layer) of natural cotton through needle punching, the carbonized fiber cotton has high heat conduction and dispersion, a uniform temperature of the carbonized fiber cotton is maintained due to rapid heat dissipation, and a low surface temperature of the carbonized fiber cotton is continuously maintained. Therefore, the natural cotton is not damaged by heat, and the surface of the natural cotton is not carbonized (See FIGS. 5 and 6).

Figure 5:
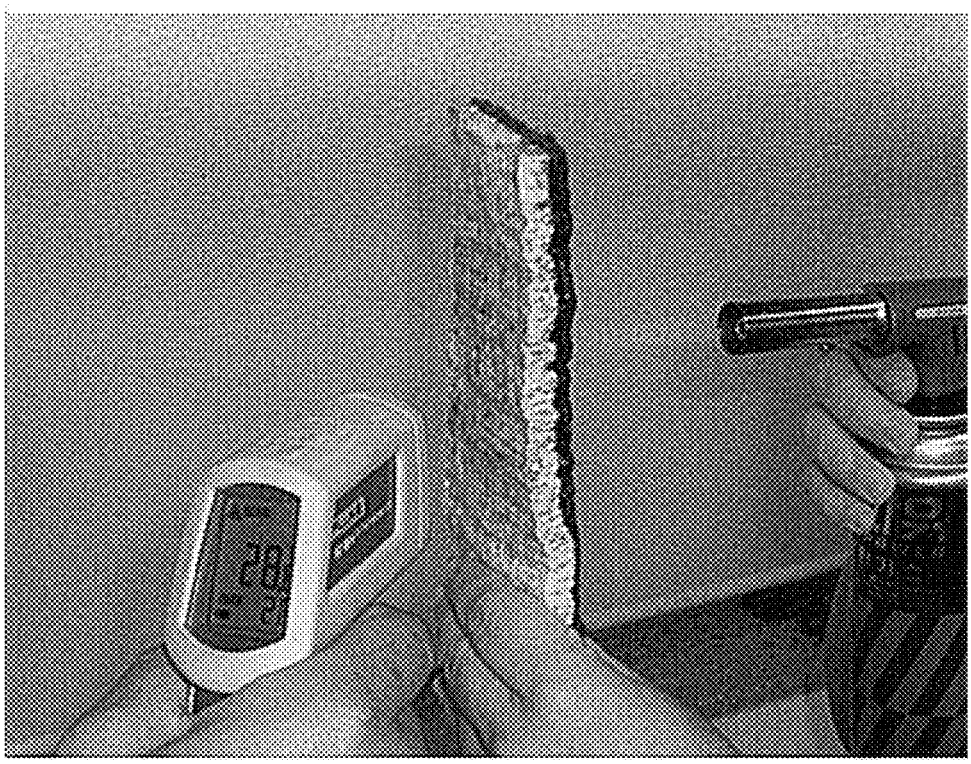
FIG. 5 is an image showing a test in which the multipurpose functional nonwoven fabric, which is manufactured by stacking carbonized fiber cotton on natural cotton, gets on fire using a torch lamp, and a temperature of heat conducted to the natural cotton is measured using an infrared-ray thermometer.

FIG. 5 shows a multipurpose functional nonwoven fabric in which carbonized fiber cotton (a thickness of 2 mm) is entangled with one surface of natural cotton (a thickness of 8 mm) through needle punching. When one plane of the nonwoven fabric with which the carbonized fiber cotton is entangled gets on fire using a torch lamp for 2 minutes, a temperature of the nonwoven fabric is measured using an infrared-ray thermometer. As a result, when the multipurpose functional nonwoven fabric composed of carbonized fiber cotton and natural cotton according to the present invention gets on fire using a torch lamp having a temperature of 1,450° C., a temperature of heat conducted to the rear surface of the natural cotton is 28° C. which is room temperature, which indicates that the multipurpose functional nonwoven fabric has very excellent thermal insulation properties.

Figure 6:
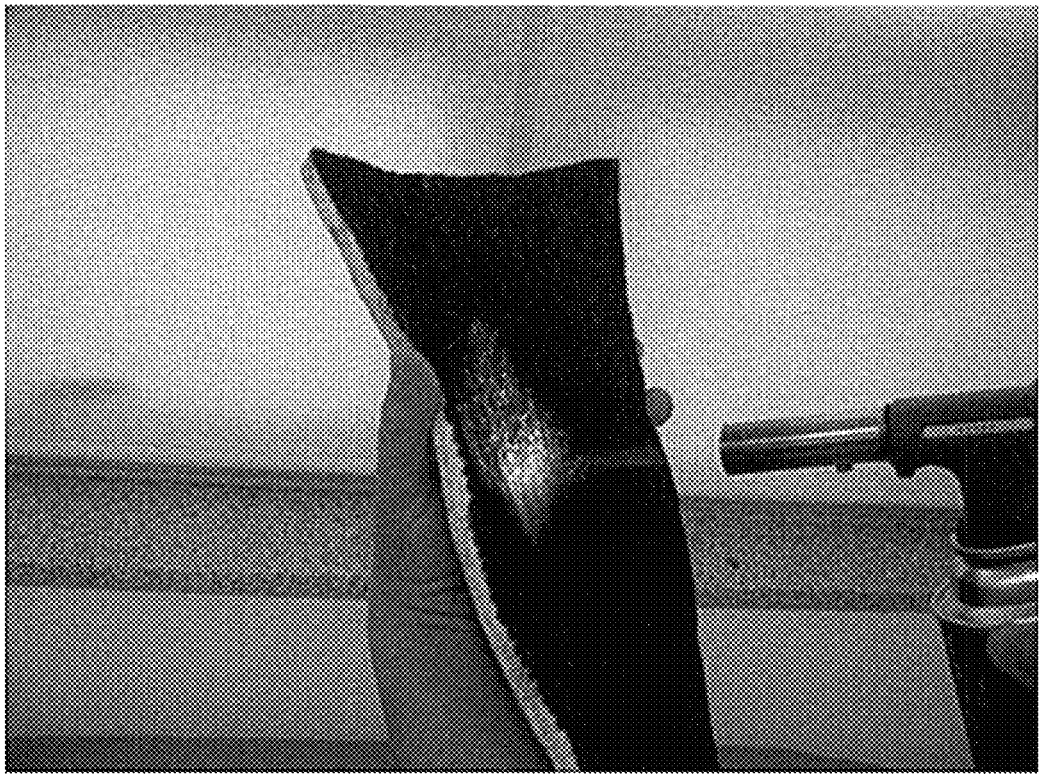
FIG. 6 is an image showing the flame-retardant and fire-retardant effects of the multipurpose functional nonwoven fabric manufactured by stacking carbonized fiber cotton on natural cotton.

FIG. 6 is an image showing a flame/fire retardancy test which is carried out by allowing a nonwoven fabric in which carbonized fiber cotton (a thickness of 2 mm) is entangled with a surface of natural cotton (a thickness of 6 mm) to get on fire. As shown in FIG. 6, even when the nonwoven fabric is continuously heated for 2 minutes using a torch lamp having a temperature of 1,450° C., the nonwoven fabric becomes red-hot, but merely feels warm when the nonwoven fabric is grabbed with hands, which indicates that the multipurpose functional nonwoven fabric has very excellent thermal retention and insulation properties. When it is assumed that the multipurpose functional nonwoven fabric withstands a high temperature of 1,450° C., the multipurpose functional nonwoven fabric is considered to show incombustibility.

Figure 7:
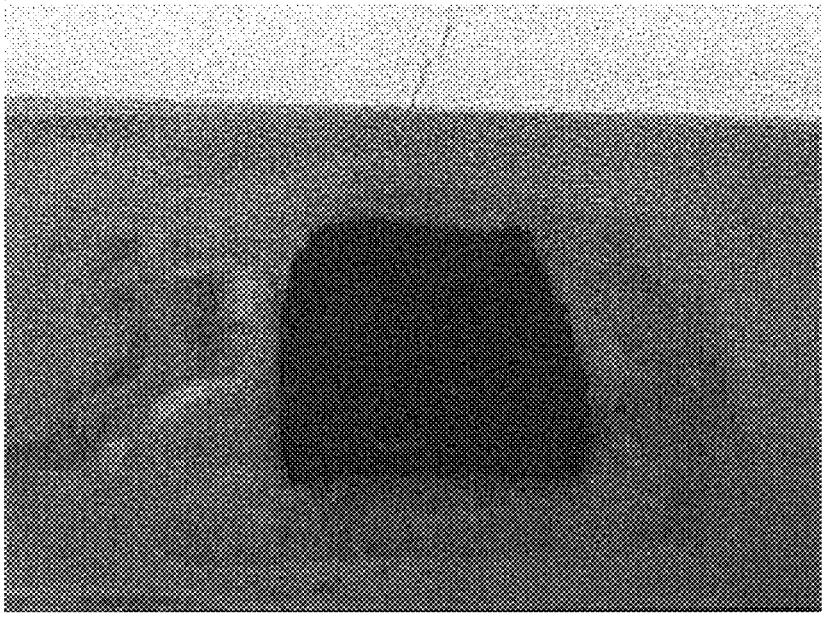
FIG. 7 is an image showing a test in which the multipurpose functional nonwoven fabric, which is manufactured by mixing natural cotton with carbonized fiber cotton, scutching the mixed cotton, and entangling the scutched cotton through needle punching, is put on a copper hot plate, and a surface temperature of heat conducted to the nonwoven fabric is measured using a thermographic camera.
Figure 7:
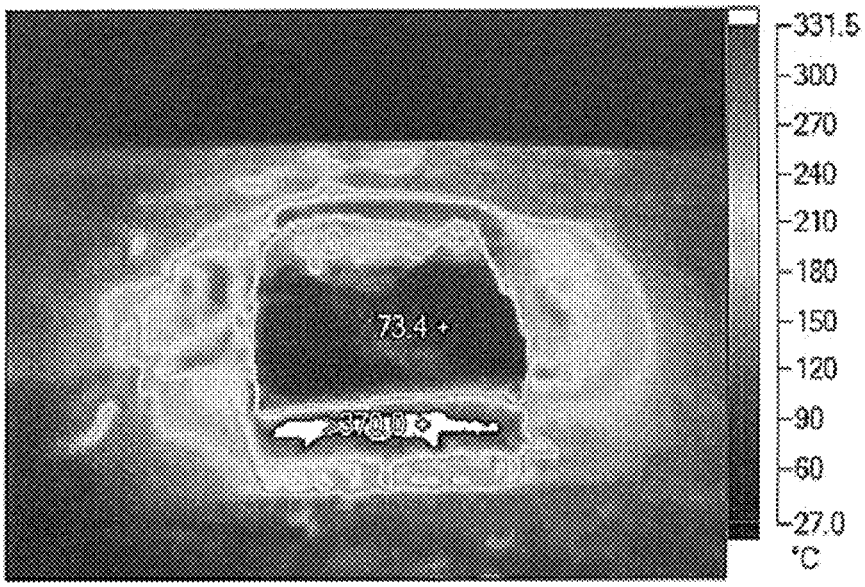

FIG. 7 shows an image of a multipurpose functional nonwoven fabric obtained by mixing natural cotton and carbonized fiber cotton (PAN) at a mixing ratio of 7:3, scutching the mixed cotton and entangling the scutched cotton through needle punching. Here, a plane of the nonwoven fabric is put on a copper hot plate (a thickness of 1.5 mm, a length of 500 mm and a width of 400 mm) heated for 2 minutes in a gas stove, and a temperature of the nonwoven fabric is measured using a thermographic camera. As shown in FIG. 7, when the temperature of the copper hot plate is 370° C., a temperature of heat conducted to the surface of the nonwoven fabric is 73° C., which indicates that the multipurpose functional nonwoven fabric has high thermal retention and insulation properties.

Figure 8:
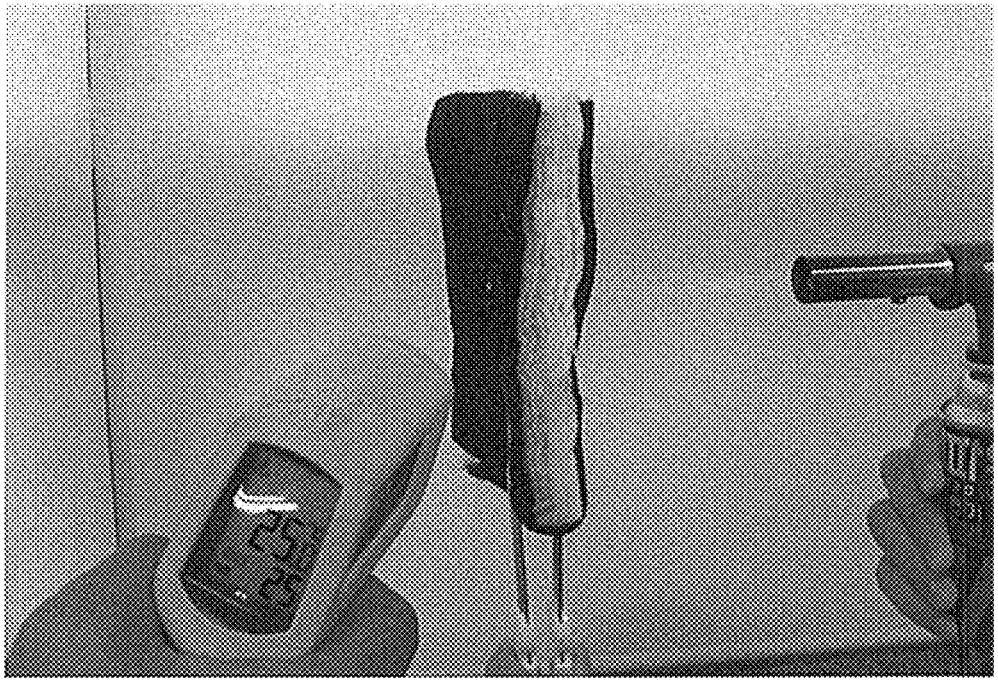
FIG. 8 is an image showing a test in which the multipurpose functional nonwoven fabric, which is manufactured by introducing natural cotton into an intermediate layer of carbonized fiber cotton, stacking the natural cotton on the intermediate layer of the web-formed carbonized fiber cotton, and entangling the stacked cotton through needle punching, gets on fire using a torch lamp, and a surface temperature of the rear surface of the nonwoven fabric is measured using an infrared-ray thermometer.

FIG. 8 shows an image of a multipurpose functional nonwoven fabric having a thickness of 24 mm, which is obtained by introducing natural cotton into an intermediate layer of carbonized fiber cotton and stacking the natural cotton on the intermediate layer of the carbonized fiber cotton. Here, the multipurpose functional nonwoven fabric gets on fire using a torch lamp, and is heated to a temperature of 1,450° C. for 2 minutes, and a temperature of heat conducted to the surface of the nonwoven fabric is measured using an infrared-ray camera. As shown in FIG. 8, the surface temperature of the rear surface of a layer of carbonized fiber cotton in the nonwoven fabric manufactured according to the present invention is measured to be 25° C., and there are no carbonized traces on a region of the natural cotton stacked on the intermediate layer of carbonized fiber cotton. As a result, it is revealed that the multipurpose functional nonwoven fabric according to the present invention has high thermal retention and insulation properties.

Figure 9:
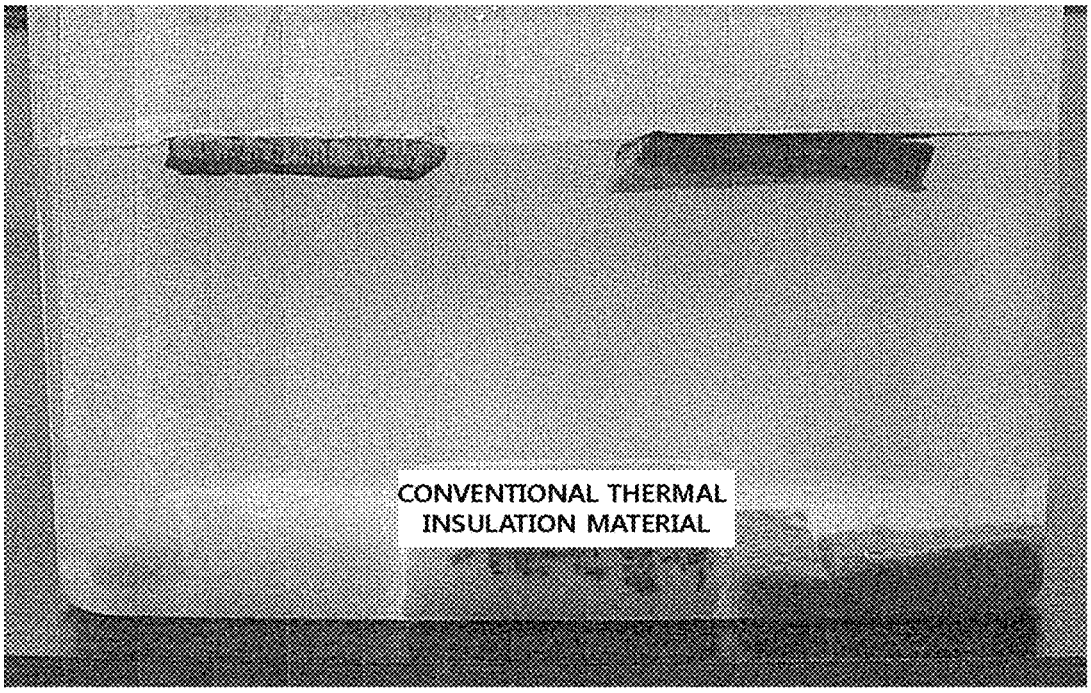
FIG. 9 is an image showing a test in which the buoyancies of the multipurpose functional nonwoven fabrics according to the present invention are compared.

FIG. 9 is an image showing a test in which buoyancies of the multipurpose functional nonwoven fabrics according to the present invention are compared. As shown in FIG. 9, a conventional thermal insulation material composed of glass wool, rock wool, and a ceramic fiber absorbs water rapidly and sinks to the bottom of a water tank, which indicates that the conventional thermal insulation material has no buoyancy at all. However, the multipurpose functional nonwoven fabric according to the present invention floats on water, which indicates that the multipurpose functional nonwoven fabric exhibits very excellent buoyancy. Therefore, it is revealed that the multipurpose functional nonwoven fabric according to the present invention has excellent buoyancy since a large number of hollow spaces and closed bubbles are formed.

When the multipurpose functional nonwoven fabric is manufactured according to the method provided in the present invention, the heat is rapidly transferred through the carbonized fiber cotton, and thus a temperature in the entangled natural cotton is continuously maintained, thereby improving thermal retention and insulation properties.

Also, the multipurpose functional nonwoven fabric manufactured according to the present invention may be produced by molding the nonwoven fabric in the form of a processed woven fabric, a nonwoven fabric, a mat, a board, pipe, an elbow, and a valve using a needle punching machine or a mold. Also, the multipurpose functional nonwoven fabric withstands fire caused by sparks in an electric power conduit, a utility pipe conduit, a driving device, a power line, a cable line, and a communication line, and fire and flames caused from the outside (fire-retardancy), prevents toxic smoke from being generated (flame-retardancy), and insulates internal heat (thermal insulation property). Therefore, the multipurpose functional nonwoven fabric manufactured according to the present invention can be manufactured and used in the form of a processed woven fabric, a tape, a nonwoven fabric, and a sleeve, all of which serve to maintain an internal temperature of an electric power conduit. That is, the multipurpose functional nonwoven fabric may be used in at least one selected from the group consisting of a thermal retention material, a flame-retardant material, a thermal insulation material, a heating material, a sound-proof material, an intermediate material for absorption of impact, a buffering material, a bullet-proof material, a knife-proof material, and a fire-fighting material.

Also, the multipurpose functional nonwoven fabric according to the present invention may be used in various industrial fields including a pipe, a valve, an elbow, a turbine, a rotational machine, a waste gas valve, a wall of a boiler, a large engine, and the like. In this case, when the multipurpose functional nonwoven fabric is used in a thermal retention material, a thermal insulation material, and a sound-proof material, the multipurpose functional nonwoven fabric may have an effect of enhancing thermal retention and insulation properties since the multipurpose functional nonwoven fabric is lightweight and thin.

In addition, the multipurpose functional nonwoven fabric according to the present invention may be used as a cryogenic thermal retention/insulation material in a transportation/storage system for LNG and LPG gases transported and stored in a liquefied state, a vessel, a vehicle, a storage tank, a barrier of a tank, a pipe, a valve, a refrigeration warehouse, a refrigerator, an ice-cream production plant, and the like.

Also, the multipurpose functional nonwoven fabric according to the present invention may be used as a multipurpose functional advanced nonwoven fabric which can be used in floors and indoor walls of buildings for the purpose of heating. The multipurpose functional nonwoven fabric according to the present invention has a thermal retention property, a thermal insulation property, a sound-proof property, a moth-proof property, and flame retardancy even though the multipurpose functional nonwoven fabric is lightweight and thin. Therefore, a construction cost and a heating cost may be cut, and the actual floor space may be more spaciously used. In addition, the multipurpose functional nonwoven fabric according to the present invention may be used in windows of the buildings to shield sunlight and ultraviolet and infrared rays, keep warmth, and insulate heat and sounds, and may also be used in a flame-resistant curtain and a screen roll which serve to prevent the spread of flame upon occurrence of fire.

In addition to the effects as the thermal retention material, the thermal insulation material, and the flame-retardant material, the multipurpose functional nonwoven fabric according to the present invention may also be used as a sound-proof material, a dew condensation-preventing material, and an intermediate material or a core material of a panel such as a sandwich panel, a metal panel, an aluminum composite panel, a refrigeration panel, and the like. Since the multipurpose functional nonwoven fabric is lightweight and thin, a design load may be lowered, a manufacturing cost such as a material cost and a construction cost may be cut, a manufacturing space may be easily ensured, and energy may be saved.

The multipurpose functional nonwoven fabric according to the present invention may be used as a flame-retardant material or a thermal insulation material in a spark/flame/fire prevention blanket capable of protecting machinery, equipment, and facilities in a site at which sparks and flames are scattered upon welding, a blanket for initial fire suppression upon occurrence of fire, a fire-fighting blanket for protection of human body upon fire escape, and for fire protection facilities.

Also, the multipurpose functional nonwoven fabric may be used as a high-quality wallpaper and an interior material. In addition to the flame retardancy, the fire retardancy, the thermal retention property, the thermal insulation property, the sound-proof property, and the moisture controlling effect, the multipurpose functional nonwoven fabric has an advantage in that it is lightweight and environmentally friendly. Also, the multipurpose functional nonwoven fabric serves to prevent the spread of flame upon occurrence of fire and does not generate smoke or gases harmful to the human body.

Further, since the multipurpose functional nonwoven fabric also has knife-proof and bullet-proof properties, the multipurpose functional nonwoven fabric may be used as a material for police uniforms, military uniforms, bulletproof jackets, fire-fighting garments, fire-fighting gloves, fire-fighting boots, special working clothes, and high-temperature industrial steel-capped boots.

Since the multipurpose functional nonwoven fabric has a thermal insulation property, a sound-proof property, a bullet-proof property, and vibration resistance to severe vibrations, the multipurpose functional nonwoven fabric may be used in engines of armored vehicles, tanks, self-propelled guns, self-propelled anti-tank guns, warships, patrol boats, submarines, helicopters, fighter planes, and the like, and may also be installed at an inner wall of an engine room, an inner wall of a cockpit, an indoor wall, and an outer wall of a fuel tank in order to cushion the impact.

Additionally, the multipurpose functional nonwoven fabric may be used as an intermediate material for absorption of impact or a buffering material in knees, chest, arms, ankles, top of the foot guards of sports goods, safety helmets, helmets, and bumpers for automobiles.

Furthermore, the multipurpose functional nonwoven fabric may be used as a filament which shows superior incombustibility and tensile and bursting strengths to conventional asbestos yarns, glass yarns, and aramid yarns, is lightweight, and has various functions. In this case, a filament produced by twisting thread formed from multipurpose functional cotton, and a filament produced by mixing carbonized fiber cotton with natural cotton may be used as the filament.

[Mode for Invention]

Hereinafter, preferred exemplary embodiments of the present invention will be described in order to aid in understanding the present invention. However, it should be understood that the description set forth herein is merely exemplary and illustrative of exemplary embodiments for the purpose of describing the present invention, but is not intended to limit the exemplary embodiments.

Example 1: Manufacture of Multipurpose Functional Nonwoven Fabric 1.1. Manufacture of Pretreated Carbonized Fiber Cotton A carbonized fiber (1,000 g) and 5 to 30% (50 to 300 g) of raw cotton were mixed in an opener device. In this case, the carbonized fiber in the form of a stable fiber (i.e., a wool-like curled shape or a corrugated paper-like shape) was unraveled, and then mixed with raw cotton to manufacture carbonized fiber cotton.

1.2. Manufacture of Multipurpose Functional Nonwoven Fabric Using Carbonized Fiber Cotton and Natural Cotton To manufacture the multipurpose functional nonwoven fabric shown in FIG. 1, the carbonized fiber cotton undergoing the pretreatment process was injected into a cutting machine to form a web, and stacked. Thereafter, the carbonized fiber cotton (having a thickness of 30 to 100 mm) and the natural cotton (having a thickness of 60 to 240 mm) were stacked such that the carbonized fiber cotton was positioned on (outside) the natural cotton. Then, the stacked cotton was reciprocatively needle-punched twice under the conditions including revolutions per minute (rpm) of 200 to 800 rpm, a speed of 2.0 to 5.0 m/min, No. of needles of 4,000 to 4,500 EA/m, and a beat density of 40 to 72 counts/cm$^2$ (see FIG. 1). In the case of the multipurpose functional nonwoven fabric as shown in FIG. 1, after the needle punching process, the thickness of the carbonized fiber cotton entangled on (outside) the natural cotton decreased from approximately 30 mm to approximately 2 mm, and the thickness of the lower natural cotton decreased from approximately 60 mm to approximately 10 mm.

Figure 2:
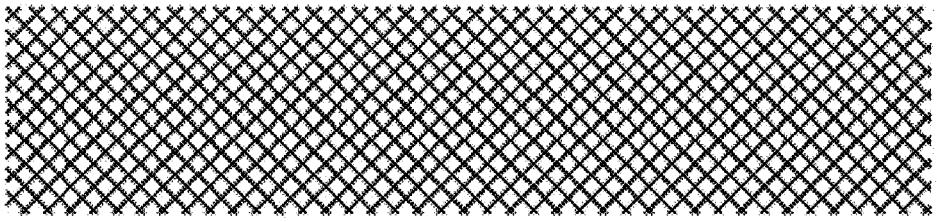
FIG. 2 is a diagram showing a multipurpose functional nonwoven fabric manufactured by mixing natural cotton with carbonized fiber cotton and scutching the mixed cotton.

Also, to manufacture the multipurpose functional nonwoven fabric shown in FIG. 2, the pretreated carbonized fiber cotton was mixed with natural cotton, and the mixed cotton was scutched. Thereafter, the scutched cotton was introduced into a cutting machine to form a web, and stacked to a thickness of 60 mm. The stacked cotton was reciprocatively needle-punched twice under the conditions including revolutions per minute (rpm) of 200 to 800 rpm, a speed of 2.0 to 5.0 m/min, No. of needles of 4,000 to 4,500 EA/m, and a beat density of 40 to 72 counts/cm$^2$ (see FIG. 2).

Further, to manufacture the multipurpose functional nonwoven fabric shown in FIG. 3, natural cotton was introduced into an intermediate layer of the pretreated carbonized fiber cotton, and stacked on the intermediate layer of the pretreated carbonized fiber cotton. Thereafter, the stacked cotton was reciprocatively needle-punched twice under the conditions including revolutions per minute (rpm) of 200 to 800 rpm, a speed of 2.0 to 5.0 m/min, No. of needles of 4,000 to 4,500 EA/m, and a beat density of 40 to 72 counts/cm$^2$ (see FIG. 3).

Each of the multipurpose functional nonwoven fabrics shown in FIGS. 1, 2, and 3 was subjected to flame-retardant (fire-retardant) treatment, and dehydration, drying process, and restoration processes.

Example 2: Test on Thermal Insulation Properties of Multipurpose Functional Nonwoven Fabric To check the thermal insulation properties of the multipurpose functional nonwoven fabrics shown in FIGS. 1, 2, and 3, the multipurpose functional nonwoven fabrics were tested using a torch lamp and a hot plate.

The multipurpose functional nonwoven fabric shown in FIG. 1 was directly heated at 1,450° C. for 2 minutes using a torch lamp, and an insulation temperature at a side of the natural cotton was measured using an infrared-ray thermometer (see FIG. 5). As a result, it could be seen that the multipurpose functional nonwoven fabric had very excellent thermal insulation properties since the insulation temperature at the side of the natural cotton was measured to be room temperature (28° C.). Also, the multipurpose functional nonwoven fabric shown in FIG. 1 was directly grabbed with hands, and then heated at 1,450° C. for 2 minutes using a torch lamp (see FIG. 6). As a result, it was revealed that it felt warm, but there were no harms caused due to a high temperature.

The multipurpose functional nonwoven fabric shown in FIG. 2 was put on a copper hot plate heated for 2 minutes using a gas burner and having a surface temperature of 370° C. Thereafter, a temperature of heat conducted to the surface of the nonwoven fabric was measured using a thermographic camera (see FIG. 7). As a result, it could be seen that the temperature of heat conducted to the surface of the nonwoven fabric was 73° C., which indicated that the multipurpose functional nonwoven fabric had high thermal retention properties.

The multipurpose functional nonwoven fabric shown in FIG. 3 was directly heated at 1,450° C. for 2 minutes using a torch lamp, and a temperature heat conducted to the surface of the nonwoven fabric was measured using an infrared-ray camera (see FIG. 8). As a result, it could be seen that the surface temperature of the rear surface of the carbonized fiber cotton layer of the nonwoven fabric was 25° C., which indicated that there was a difference of 1425° C. from the temperature (1,450° C.) of the torch lamp. Also, it could be seen that there were no carbonized traces on a region of the natural cotton stacked on the intermediate layer of the carbonized fiber cotton, which indicated that the multipurpose functional nonwoven fabric had high thermal retention and insulation properties.

Example 3: Comparison Test on Buoyancies of Multipurpose Functional Nonwoven Fabrics To compare buoyancies of the multipurpose functional nonwoven fabrics (FIGS. 1, 2, and 3) according to the present invention, the multipurpose functional nonwoven fabrics were put into a water tank containing water together with a conventional thermal insulation material composed of glass wool, rock wool, and a ceramic fiber (see FIG. 9). As a result, it could be seen that the conventional thermal insulation material absorbed water and sunk to the bottom of a water tank, which indicated that the conventional thermal insulation material had no buoyancy at all. However, it could be seen that the multipurpose functional nonwoven fabrics (FIGS. 1, 2, and 3) according to the present invention floated for a long period of time, which indicated that the multipurpose functional nonwoven fabrics had very excellent buoyancy, as shown in FIG. 9.

Example 4: Evaluation Test on Flame Retardancy and Fire Retardancy of Multipurpose Functional Nonwoven Fabric The flame (fire) retardancy of the multipurpose functional nonwoven fabric according to the present invention was tested using a Meker burner method according to the test criteria specified in the Law Enforcement Ordinance of Maintenance and Safety Control Fire-Fighting Systems Act. The results are listed in the following Table 1 and shown in FIG. 10 (Test Report).

TABLE 1

| Item | Measured value | Test criteria | Note |
|---|---|---|---|
| After-flame time (S) | 0 | Within 10 | |
| After-glow time (S) | 0 | Within 30 | |
| Carbonization area ($cm^2$) | 26.2 | Within 50 | |
| Carbonization length (cm) | 6.9 | Within 20 | |
| Acceptance | | Pass | |

As listed in Table 1, the multipurpose functional nonwoven fabric manufactured in the present invention exhibited an after-flame time of 0 seconds and an after-glow time of 0 seconds, which were much lower than the test reference values, that is, the after-flame time of 10 seconds and the after-glow time of 30 seconds, a carbonization area of 26.2 $cm^2$, which is much better than the reference value of 50 $cm^2$, and a carbonization length of 6.9 cm, which is much better than the reference value of 20 cm, and passed a flame retardancy (fire retardancy) test.

Example 5: Test for Evaluation of Tensile Strength of Multipurpose Functional Nonwoven Fabric The tensile strength of the multipurpose functional nonwoven fabric according to the present invention was tested using a C.R.E. strip method. The results are listed in Table 2 and shown in FIG. 10 (Test Report).

TABLE 2

<Units: N/5 cm (kfg/5 cm)>

| Item | Measured value | Test criteria | Note |
|---|---|---|---|
| Length direction | 406 | 41 | Approximately 10 times |
| Width direction | 2,231 | 227 | 9.83 times |

As listed in Table 2, it could be seen that the multipurpose functional nonwoven fabric had a tensile strength of 406 N/5 cm (kgf/5 cm) in a length direction, which was 9.902 times (approximately 10 times) the reference value of 41 N/5 cm (kgf/5 cm), and a tensile strength of 2,231 N/5 cm (kgf/5 cm) in a width direction, which was 9.83 times the reference value of 227 N/5 cm (kgf/5 cm), which indicated that the multipurpose functional nonwoven fabric had much higher tensile strength.

Example 6: Bursting Strength Test of Multipurpose Functional Nonwoven Fabric

The bursting strength of the multipurpose functional nonwoven fabric according to the present invention was tested using a hydraulic method. The results are listed in Table 3 and shown in FIG. 10 (Test Report).

TABLE 3

<Units: KPa ($kfg/cm^2$)>

| Item | Measured value | Test criteria | Note |
|---|---|---|---|
| Measured value | 4,903 | 50 | 98.06 times |

As listed in Table 3, it could be seen that the bursting strength of the multipurpose functional nonwoven fabric according to the present invention was much higher than the reference value.

Example 7: Cold Resistance Test on Multipurpose Functional Nonwoven Fabric

The cold resistance of the multipurpose functional nonwoven fabric according to the present invention was tested at −40° C. for 6 hours. The results were evaluated to be 'none.'

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

The multipurpose functional nonwoven fabric according to the present invention can be used for materials for fire protection in electric power conduits such as a flame-retardant thermal retention/insulation material, a flame-retardant/cold-resistant material, a flame-retardant sound-absorbing material, a cryogenic thermal retention/insulation material for flame-retardant LNG and LPG gases, a thermal retention/insulation material used for flame retardancy at a high temperature, a flame-retardant high-temperature filtering material, a flame-retardant interior material, a flame-retardant filament, a processed woven fabric, a mat, a board, a sandwich panel, and a metal panel, and interior materials such as a flame prevention blanket upon welding and a wallpaper, and can be used in various industrial fields such as a flame-resistant curtain, a fire-fighting garment, an assault jacket, and the like.

The invention claimed is:

1. A method for manufacturing a multipurpose functional nonwoven fabric, comprising:

(1) preparing carbonized fiber cotton by unraveling a carbonized fiber and mixing the carbonized fiber and raw cotton at a mixing ratio of 7:3 to 8:2;

(2) injecting the carbonized fiber cotton into a cutting machine to form a web;

(3) stacking the web-formed carbonized fiber cotton and natural cotton so that the web-formed carbonized fiber cotton is positioned on the natural cotton and needle-punching the stacked cotton; and (4) subjecting the needle-punched cotton to flame-retardant and fire-retardant treatment, dehydration, and drying.

2. The method of claim 1, wherein the needle punching conditions comprise revolutions per minute (rpm) of 200 to 800 rpm, a speed of 2.0 to 5.0 m/min, No. of needles of 4,000 to 4,500 EA/m, and a beat density of 40 to 72 counts/$cm^2$.

3. The method of claim 1, wherein the needle punching is reciprocatively performed once from top to bottom and once from bottom to top.

4. A method for manufacturing a multipurpose functional nonwoven fabric, comprising:

(1) preparing carbonized fiber cotton by unraveling a carbonized fiber and mixing the carbonized fiber and raw cotton at a mixing ratio of 7:3 to 8:2;

(2) injecting the carbonized fiber cotton into a cutting machine to form a web;

(3) introducing natural cotton into an intermediate layer of the web-formed carbonized fiber cotton, stacking the natural cotton on the intermediate layer of the web-formed carbonized fiber cotton, and needle-punching the stacked cotton; and (4) subjecting the needle-punched cotton to flame-retardant and fire-retardant treatment, dehydration, and drying.

5. The method of claim 4, wherein the needle punching conditions comprise revolutions per minute (rpm) of 200 to 800 rpm, a speed of 2.0 to 5.0 m/min, No. of needles of 4,000 to 4,500 EA/m, and a beat density of 40 to 72 counts/$cm^2$.

6. The method of claim 4, wherein the needle punching is reciprocatively performed once from top to bottom and once from bottom to top.

7. A method for manufacturing a multipurpose functional nonwoven fabric, comprising:

(1) preparing carbonized fiber cotton by unraveling a carbonized fiber and mixing the carbonized fiber and raw cotton at a mixing ratio of 7:3 to 8:2;

(2) mixing natural cotton with the carbonized fiber cotton and scutching the resulting mixed cotton;

(3) injecting the mixed/scutched cotton into a cutting machine to form a web, stacking the web-formed cotton, and needle-punching the stacked cotton; and (4) subjecting the needle-punched cotton to flame-retardant and fire-retardant treatment.

8. The method of claim 7, wherein the needle punching conditions comprise revolutions per minute (rpm) of 200 to 800 rpm, a speed of 2.0 to 5.0 m/min, No. of needles of 4,000 to 4,500 EA/m, and a beat density of 40 to 72 counts/$cm^2$.

9. The method of claim 7, wherein the needle punching is reciprocatively performed once from top to bottom and once from bottom to top.

* * * * *